United States Patent [19]

Schippers et al.

[11] Patent Number: 4,561,603

[45] Date of Patent: Dec. 31, 1985

[54] YARN TRAVERSE APPARATUS AND METHOD

[75] Inventors: Heinz Schippers; Erich Lenk, both of Remscheid; Herbert Schiminski, Hückeswagen; Herbert Turk, Remscheid, all of Fed. Rep. of Germany

[73] Assignee: Barmag Barmer Maschinenfabrik AG, Remscheid, Fed. Rep. of Germany

[21] Appl. No.: 694,952

[22] Filed: Jan. 25, 1985

Related U.S. Application Data

[63] Continuation-in-part of Ser. No. 566,583, Dec. 29, 1983, Pat. No. 4,505,436, and a continuation-in-part of Ser. No. 571,508, Jan. 17, 1984, Pat. No. 4,505,437.

[30] Foreign Application Priority Data

Jan. 27, 1984 [EP] European Pat. Off. ..... 84100848.5

[51] Int. Cl.[4] ..... B65H 54/28

[52] U.S. Cl. ..... 242/43 A

[58] Field of Search ..... 242/43 A, 43 R, 158 B

[56] References Cited

U.S. PATENT DOCUMENTS

| | | | |
|---|---|---|---|
| 3,374,961 | 3/1968 | Otsuka et al. | 242/43 A |
| 3,650,486 | 3/1972 | Hasegawa et al. | 242/43 A |
| 4,165,047 | 8/1979 | Mackie | 242/43 A |

FOREIGN PATENT DOCUMENTS

| | | | |
|---|---|---|---|
| 3243985 | 6/1983 | Fed. Rep. of Germany | 242/43 A |
| 1541176 | 8/1968 | France | 242/43 A |
| 40-17090 | 8/1965 | Japan | 242/43 A |
| 46-16298 | 5/1971 | Japan | 242/43 A |
| 46-37025 | 10/1971 | Japan | 242/43 A |
| 47-12898 | 4/1972 | Japan | 242/43 A |
| 448835 | 4/1968 | Switzerland | 242/43 A |

*Primary Examiner*—Stanley N. Gilreath

*Attorney, Agent, or Firm*—Bell, Seltzer, Park & Gibson

[57] ABSTRACT

A yarn traverse apparatus and method are disclosed for winding a running yarn onto a rotating package, and wherein at each end portion of the traverse stroke there is provided a guide rail, and a pair of oppositely rotating arms mounted for rotation about closely adjacent parallel, or coaxial axes. One arm moves the yarn along the guide rail and toward the end of the stroke, and the other arm returns the yarn toward the center of the stroke. The guide rail and/or the arms include means for guiding the yarn adjacent each of the ends of the stroke such that the yarn is free to rebound a short distance toward the center of the stroke, and is then restrained in such movement, and so that proper engagement of the yarn by the extremity of the arm moving into the traverse stroke is assured.

16 Claims, 11 Drawing Figures

YARN TRAVERSE APPARATUS AND METHOD

This is a continuation-in-part of copending application Ser. No. 566,583, filed Dec. 29, 1983, now U.S. Pat. No. 4,505,436, and application Ser. No. 571,508, filed Jan. 17, 1984, now U.S. Pat. No. 4,505,437.

The present invention relates to a yarn traverse apparatus and method for use on a yarn winding machine for reciprocating the yarn transversely to its running direction over a predetermined traverse stroke and to thereby wind the running yarn onto a rotating package.

Yarn traverse apparatus are known wherein a pair of oppositely rotating guide arms are employed to convey the yarn in each traversing direction, note for example U.S. Pat. Nos. 3,650,486 and 3,374,961, Swiss Pat. No. 448,835, Japanese Pat. No. 71-37025, and German Offenlegungsschrift No. 32 43 985. A problem associated with traversing apparatus of the described type resides in the fact that depending on the chosen winding conditions such as yarn speed, yarn denier, yarn tension, traverse length, traverse speed, package diameter it may be difficult to reliably transfer the yarn from the arm moving it toward the end of the traverse stroke, to the arm moving the yarn away from the end of the stroke. This difficulty arises principally by reason of the fact that when the yarn is at the end of the traverse stroke, it is deflected from its natural running direction which is perpendicular to the axis of the take-up package. Thus the yarn is under increased tension when it is located at the ends of the stroke, and the yarn tends to run toward the center of the stroke faster than the speed of the arm which is intended to move the yarn at a predetermined traverse speed. This uncontrolled movement, or rebound, disturbs the formation of a precisely cylindrical package to the effect that the resulting package may contain unacceptable bulges or waviness, particularly adjacent the ends.

Heretofore, it has been suggested that the accurate transfer of the yarn between the two rotating arms may be facilitated by the eccentric mounting of the axes of the two arms. However, an eccentric mounting complicates the construction of the apparatus. In addition, the above cited U.S. Pat. No. 3,650,486 discloses a fixed guide at each end of the stroke for applying a frictional force to restrain the return movement of the yarn toward the center of the stroke, and the cited German Offenlegungsschrift describes an arm construction which is also designed to control the return movement of the yarn toward the center of the stroke. Specifically, the German Offenlegungsschrift discloses a guide arm having an outer extremity which includes a trailing edge which is configured to cooperate with a fixed guide bar in engaging the yarn after the yarn has reached the end of the traverse stroke, and so as to control the movement of the yarn toward the center of the stroke. However, these prior practices have not proved to be completely satisfactory in all instances.

It is accordingly an object of the present invention to provide a yarn traverse apparatus and method of the described type and which includes improved means for effectively preventing the yarn from moving from the end of the traverse stroke at a speed faster than the intended traverse speed, and which also facilitates the controlled transfer of the yarn from the arm leaving the traverse stroke to the arm entering the traverse stroke.

More particular objects of the present invention include the provision of a yarn traverse apparatus and method which assures a precise transfer of the yarn from one guiding arm to the other, which achieves a proper disposition of the yarn on the package, particularly at the ends of the package, and which permits the arms to be mounted for rotation about concentric axes.

These and other objects and advantages of the present invention are achieved in the embodiments illustrated herein by the provision of a yarn traverse apparatus and method which includes at each of the ends of the traverse stroke a guide rail extending generally in the direction of the yarn traverse, and a pair of guide arms mounted for rotation about closely adjacent parallel or coaxial axes and so that the extremity of each rotating arm is adapted to pass through the yarn path of travel and along the guide rail. Means are also provided for rotating the arms in opposite directions, so that one arm moves along the guide rail in the direction toward the end of the traverse stroke, and the other arm moves along the guide rail in the opposite direction and from the end of the traverse stroke toward the center of the stroke. In accordance with the present invention, means are also provided for guiding the yarn adjacent each of the ends of the traverse stroke such that the yarn is essentially free to rebound toward the center of the stroke within a distinct short initial traverse distance from the end of the stroke toward the center of the stroke, and is then restrained in such movement within a distinct second traverse distance which is adjacent the initial traverse distance. By the above construction, the proper engagement of the yarn by the extremity of the arm moving toward the center of the traverse stroke is assured. In addition, it has unexpectedly been found that with the present invention, the rotational axes of the two arms may be concentrically mounted. In this regard, it should be noted that in accordance with the present invention only a very short free rebound distance, within a range of a few millimeters, is permitted before the yarn is restrained and the approaching arm has entered the stroke sufficiently far so as to safely take over the guiding of the yarn.

In one specific embodiment of the present invention, the means for guiding the yarn adjacent each of the ends of the traverse stroke comprises inner and outer guide rails disposed on opposite sides of the advancing yarn, and with the inner and outer rails being separated from each other in plan view adjacent the end of the traverse stroke to an extent sufficient to define the short initial traverse distance, and with the rails overlapping each other adjacent the initial traverse distance to such an extent that they define the second traverse distance. Thus within the short initial traverse distance, the guide rails present no significant restriction to the tendency of the yarn to rebound toward the center of the stroke, but over the second traverse distance, the yarn is looped over the edges of the guide rails, and a controlled braking action from the resulting frictional forces is thereby achieved. The proper engagement of the yarn by the approaching arm is thereby assured.

In another specific embodiment of the invention, the means for guiding the yarn adjacent each of the ends of the stroke comprises a trailing edge on the outer extremity of the arm which is leaving the traverse stroke, with the trailing edge including a concavely curved portion which extends rearwardly from the outermost tip of the arm, and a convexly curved portion which extends rearwardly from the concavely curved portion. Thus the yarn is adapted to move freely in the short initial traverse distance up to the end of the concavely curved portion, where it is then engaged by the convexly curved portion which defines the second traverse distance. This engagement with the convexly curved portion serves to restrain movement of the yarn toward the center of the stroke, and permits the approaching arm to properly engage the same.

In still another specific embodiment of the invention, the means for guiding the yarn adjacent each of the ends of the stroke comprises a guide rail which includes a portion adjacent the end of the traverse stroke which has an inclination with respect to the direction of the traverse stroke which is relatively small so as to define the short initial traverse distance, and a more inclined portion adjacent the initial traverse distance which defines the second traverse distance. The more inclined portion is sufficiently inclined with respect to the direction of the traverse stroke so as to engage and frictionally restrain the yarn in its movement toward the center of the stroke. The specific inclination of this latter portion makes it possible to predetermine the extent of the braking action, so that the steepness of the inclination determines the speed and length of the rebound.

It should also be noted that the indicated specific embodiments of the invention may be combined with each other, so as to make the guiding of the yarn even more reliable, in cases where one measure alone is not sufficient to accomplish the desired accuracy of the traversing motion.

As indicated above, the tendency of the yarn to rebound from the ends of the traverse stroke depends on the yarn tension. If the tension forces are too low, there is the risk that the approaching arm will miss the yarn. To avoid this risk, it is preferred that the length of the traverse stroke, i.e., the secantial distance between the end points of the traverse stroke, which is the secantial length of the guide rail over which the concentrically mounted blades overlap the rail, should be slightly less than the secantial distance between the two crossing points of the arm tips. It should here be noted that the secantial distance between the crossing points of the arm tips is determined by the radius of the blade tips, and in addition, by the number of blades on the rotor. Thus for example, if each rotor possesses two arms at an angular distance of 180°, the sector angle between the crossing points of the blades of the two rotors will be 90°. By correspondingly shaping the guide rail, it may be provided that the portion of the guide rail which is overlapped by the extremities of the arms to thereby positively guide the yarn to the respective ends of the traverse stroke may be centered within this angle. Here again, it should be noted that the differences in lengths described herein are within the range of a few millimeters.

Some of the objects and advantages of the present invention having been stated, others will appear as the description proceeds, when taken in conjunction with the accompanying schematic drawings, in which—

Figure 1:
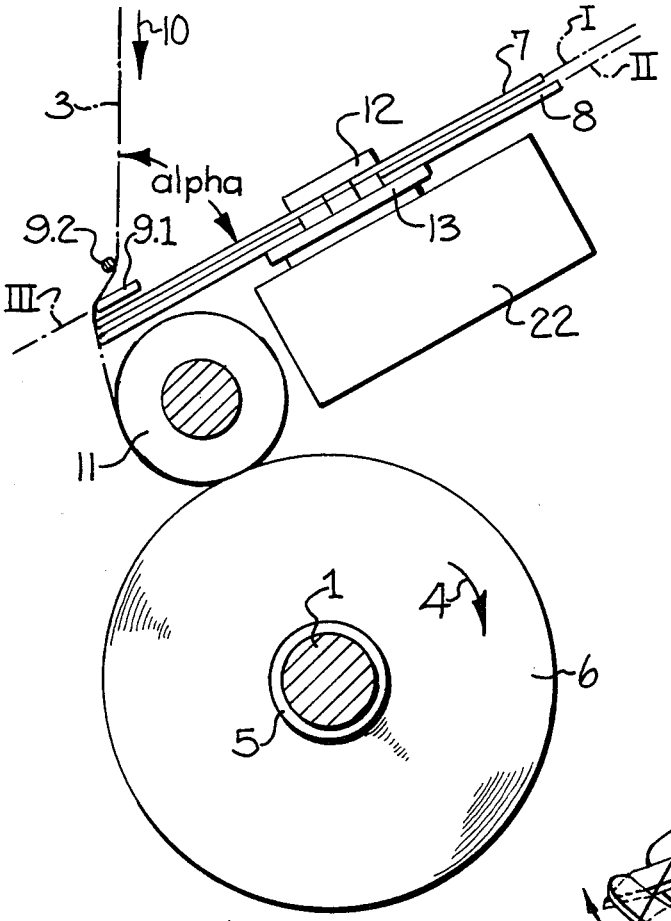
FIG. 1 is a sectional side elevation view of a yarn winding station which includes a yarn traverse apparatus in accordance with the present invention.

Referring more particularly to the drawings, FIG. 1 schematically illustrates a yarn winding station wherein a yarn 3 runs in the direction of arrow 10, through the yarn traversing apparatus 2, then partially around the drive roll 11, and finally onto the rotating bobbin 5 to form a package 6. The bobbin 5 is mounted on the take-up spindle 1, and a motor (not shown) is connected to the spindle 1 and drives the same in the rotary direction 4. Several bobbins 5 are coaxially positioned on the spindle, and a cross wound yarn package is formed on each bobbin 5 from a yarn 3 being delivered thereto. Typically, the yarn is delivered in a vertical direction, and three to eight yarns are delivered parallel to each other and wound on respective bobbins 5 to form a corresponding number of packages 6.

The yarn traversing apparatus 2 comprises two rotors, each having several rotating arms 7 and 8, which are arranged in two parallel planes of rotation I and II. A yarn guide 9 is located above these blades, along which the yarn is guided while traversing. The yarn guide includes an inner guide rail 9.1 on one side of the plane of the yarn path, and it may also include an outer guide rail 9.2 which is positioned on the other side of the plane of the yarn path.

The yarn guide 9 is positioned in a third plane III, and the planes of rotation I, II, and the plane III are inclined so as to define an angle alpha ranging between about 45° to 70° with respect to the direction of the yarn delivery, i.e. the direction indicated by the arrow 10. With this arrangement, it is accomplished that a guide roll 11 may be installed at a very short distance below the plane of rotation II. The yarn is in contact with this guide roll 11, and is guided to the respective package 6, with the guide roll 11 resting against the circumference of the package. However, the guide roll 11 may be slightly spaced from the package surface, and separately driven.

The arms 7 of each yarn traversing apparatus, which rotate in the plane I, are fixed to the rotor 12. The arms 8, which rotate in plane II, are fixed on the rotor 13, which includes a hollow shaft. In accordance with one embodiment of the invention, the hollow shaft of the rotor 13 is concentric to the rotational axis of the rotor 12. A drive (not shown) is operatively connected to a gear transmission 22, causing the rotors to rotate in opposite directions, at the same speed and in a predetermined phase relationship. Further details of the drive construction may be obtained by reference to published European application No. EU-84100433.6.

Figure 2:
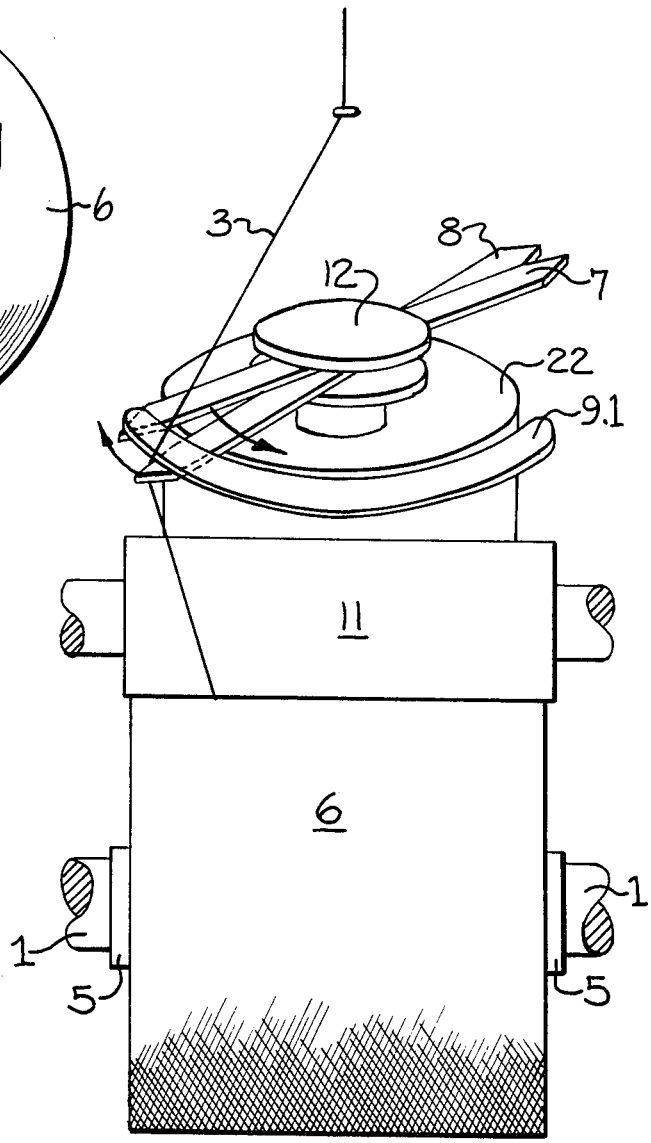
FIG. 2 is a fragmentary front elevation view of the apparatus shown in FIG. 1.

In the embodiment illustrated in FIGS. 1 and 2, the traversing assembly comprises a pair of rotors, each having two arms 7 and 8 which encompass the entire traverse stroke. The traversing assembly may alternatively comprise one pair of rotors arranged at each end portion of the traverse stroke, and any type of traversing assembly in the middle portion of the stroke. Also, the guide rail 9.1 extends over the entire traverse stroke H and is positioned on the inside of the yarn path, i.e. on the side of the axes of the rotors.

Figure 3:
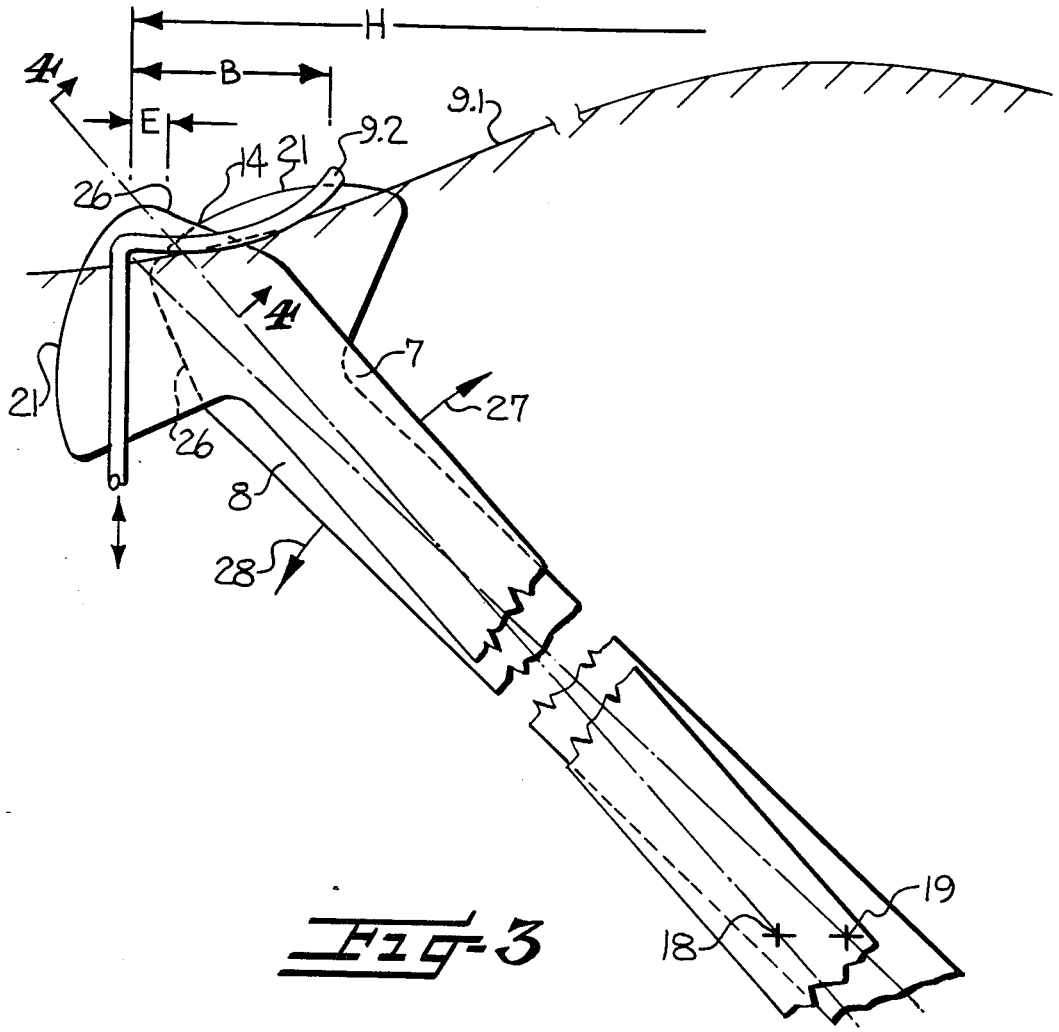
FIG. 3 is a fragmentary plan view of the end portion of the traverse stroke and illustrating the structural details of one embodiment of the present invention.
Figure 4:
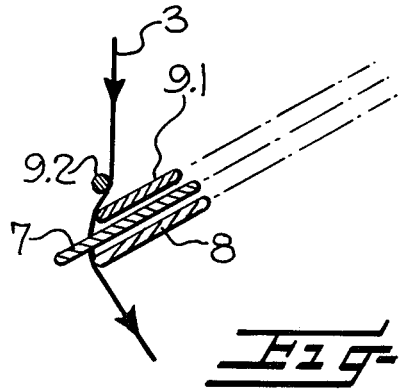
FIG. 4 is a sectional view taken substantially along the line 4—4 of FIG. 3.

FIGS. 3 and 4 illustrate the constructional details of a specific embodiment of the present invention. As illustrated, the arm 8 rotates in direction 28 about an axis 19 so as to move toward the end of the traverse stroke H, and the arm 8 includes a leading edge 26 facing in the direction of movement, and which is thus adapted to move the yarn 3 along the guide rail 9.1 toward the end of the stroke. The edge 26 is straight and is inclined with respect to the radial direction of the arm, and the inclination or profile of the edge 26 and the shape of the guide rail 9.1 are designed with respect to each other so that the yarn is moved in the traverse direction at a predetermined speed. The arm 8 further includes a trailing edge 21 on the outer extremity which extends away from the outermost tip of the leading edge 26. The arm 7 rotates about axis 18 in the direction 27 which is toward the center of the traverse stroke, and includes a similar leading edge 26 and a trailing edge 21. The axes 18 and 19 are parallel to each other, but laterally offset.

The guide rail 9.1 of FIGS. 3 and 4 extends over the entire traverse stroke H and is positioned on the inside of the yarn 3, and the guide rail 9.2 is in the form of a wire bow at each end of the stroke and which is positioned on the opposite side of the yarn. In the illustrated embodiment, the wire bow 9.2 extends only within the range B of the end of the traverse stroke. In addition, the wire bow is arcuately curved along its length so as to negatively and positively overlap the guide rail 9.1 in a predetermined manner which is determined empirically and as a function of the measured yarn tension. More particularly, the outer guide rail 9.2 is curved so that the inner and outer rails have no substantial overlap or are separated from each other in plan view adjacent the end of the traverse stroke to define a distinct short initial traverse distance E from the end of the stroke toward the center of the stroke, and the rails then overlap each other in plan view to define a distinct second traverse distance which is adjacent the distance E, and wherein the yarn is looped about the guide rails in the manner illustrated in FIG. 4.

The positive overlapping of the guide rails serves the purpose to deflect the yarn over the guide rails in a certain angle of deflection, and in addition, the yarn is tensioned between the slot formed between the guide rails and the gusset or cusp 14 formed by the leading edge 26 of the arm 7, which conveys the yarn toward the center of the stroke, and the trailing edge 21 of the arm 8 which is leaving the traverse stroke. The yarn is thereby deflected and tensioned in a manner such that it is subjected to a predetermined braking frictional force which acts both in the direction of yarn run, and in the traversing direction. The braking force acting in the direction of the yarn run serves to compensate for fluctuations in the yarn tension which occur during the traversing motion. Such fluctuations are caused by the fact that in the reversal areas the direction is reversed, and the yarn portion running on the bobbin lags behind the traverse device, i.e. leading edge 26 which conveys the yarn toward and from the end of the stroke. In the direction of traversing motion, the braking forces are by design sufficient such that the yarn is prevented from performing uncontrolled movement or rebound toward the center of the traverse stroke, which is caused by its tension. The deflection and tensioning of the yarn between the guide rails and the yarn conveying edge 26 and trailing edge 21 of the arms takes place only after the stroke reversal, and thereby serves to avoid the tension of the yarn breaking down after stroke reversal.

As indicated above, the guide rails 9.1 and 9.2 overlap negatively in the area E which is immediately adjacent the end of the traverse stroke. Hence within this area E, no or only slight braking forces are exerted in the direction of traversing motion. This is desirable, in that the yarn is able to make a short return jump or rebound at the end of the traverse stroke, when the yarn is released by the arm 8. This return jump or rebound insures that the yarn may be safely engaged by the arm 7 which is moving into the traverse stroke.

It will be apparent from FIGS. 3 and 4 and has just been briefly mentioned that the tension of the yarn may be controlled to be uniform over the entire traverse stroke by changing the degree of overlap of the guide rails as well as by the design of the concave bulging of the trailing edge of the arm 8. These are also optimum means for compensating for the changes in yarn length during movement of the yarn in the traversing triangle. It should be noted in this respect that the length of yarn between the stationary yarn guide at the apex of the traversing triangle and the bobbin which forms the base of the triangle changes considerably during each traverse stroke. The length is small when the yarn is in the center of the traverse stroke, and the length is at its maximum when the yarn traverse device reaches the ends of the traverse strokes. The length drastically decreases just after reversal of the traverse device, when the traverse device returns from the stroke and runs in a direction opposite to that yarn portion running onto the bobbin and lagging behind the traverse device. These differences in yarn length cause fluctuations in yarn tension. To avoid these differences and fluctuations, the degree of overlap of the guide rails and eventually the degree of concave bulging of the trailing edge should be correlated to the theoretical differences in yarn length or fluctuations in yarn tension in such a way that a theoretical decrease in yarn length caused by the traverse motion is compensated by an increasing deflection and tensioning of the yarn between the guide rails and the concave bulging of the trailing edge.

Figure 5:
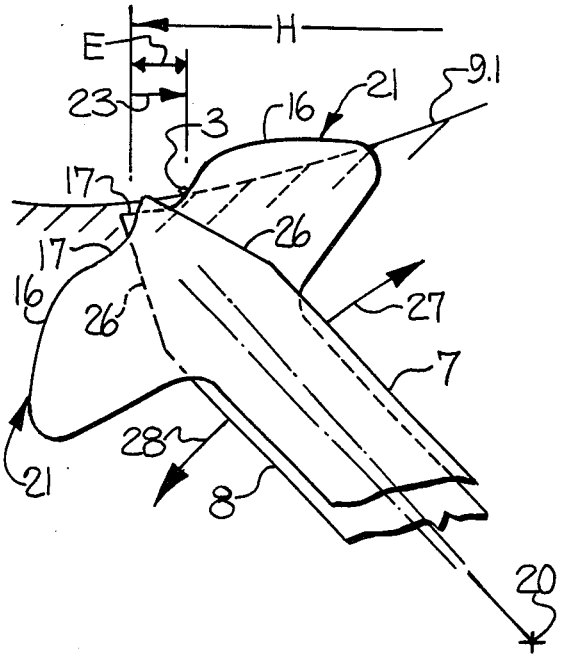
FIGS. 5–7 are views similar to FIG. 3, and illustrating three further embodiments of the present invention.

FIG. 5 is a fragmentary view similar to FIG. 3, and illustrating a further embodiment of the present invention. In this embodiment, the two arms rotate about a common axis 20. Also, the trailing edge 21 of each of the arms includes a concavely curved portion 17 which extends rearwardly from the outermost tip, and a convexly curved portion 16 which extends rearwardly from the concavely curved portion. Thus when the outermost tip of the arm 8 moves below the guide rail 9.1 as seen in FIG. 5, and the yarn is released from the leading edge 26, the yarn will be unguided for a short interval, and until the concavely curved portion 16 of the arm 8 appears above the guide bar and thus again forms a guidance for the yarn. Within this short distance E from the end of the traverse stroke, where the yarn is not positively guided, the yarn is able to freely jump back or rebound in the direction 23, which is permitted by the concavely curved portion 17 of the trailing edge. This return jump or rebound is utilized to enable the arm 7 which enters the traverse stroke to move above the guide rail 9 a sufficient distance with its leading edge so as to safely engage the yarn.

Figure 6:
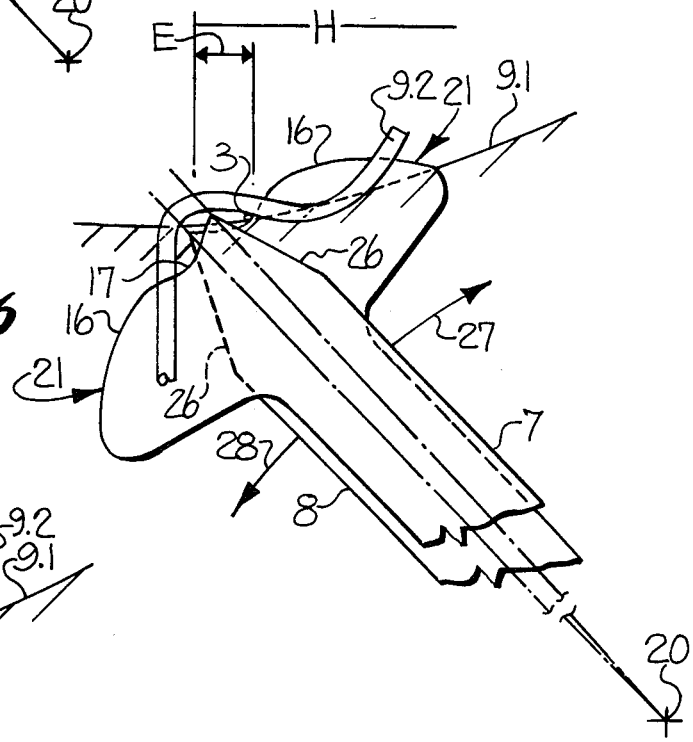

FIG. 6 is a view of another embodiment, which is similar to the embodiment shown in FIG. 5 with the exception that it also includes an opposite guide rail 9.2 as described above with reference to FIG. 3. Thus in the embodiment of FIG. 6, the curvature of the guide rail 9.2 is adapted to permit the rebound of the yarn, and then to further restrain movement of the yarn toward the center of the stroke at the point in time when the yarn is engaged by the convexly curved portion of the trailing edge of the yarn 8.

Figure 7:
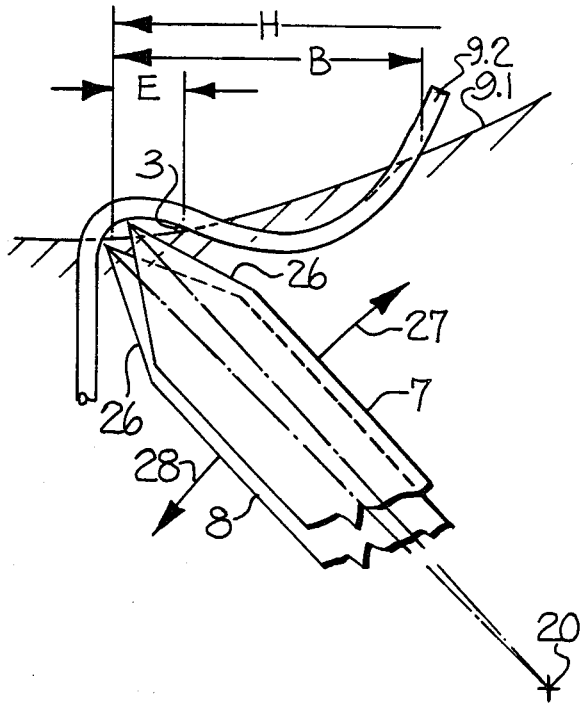

FIG. 7 illustrates a further embodiment wherein the arms include pointed extremities, and the guide rails 9.1 and 9.2 overlap in the manner generally illustrated in FIG. 3. FIG. 7 illustrates the moment which immediately follows the moment at which the leading edge 26 of the arm 8 leaves the traverse stroke and has moved below the guide rail 9.1 and released the yarn. At this point in time, the leading edge 26 of the arm 7 entering the traverse stroke has not yet emerged from below the guide rail 9.1. Thus the yarn has finished its traversing motion toward the end of the stroke, and the yarn is no longer guided in the traversing direction. Therefore, the yarn is free to rebound toward the center of the stroke by reason of its tension, and for this purpose, the guide rails 9.1 and 9.2 are designed such that a small distance E is provided at the end of the stroke within which the guide rails do not overlap, or overlap only slightly, as compared to the extent of overlap within the remaining portion of the end portion B of the stroke. Thus within the range E, the yarn is free, or only slightly restrained, and is able to rebound from the end of the stroke in the direction toward the center of the stroke. However, in the remaining range B wherein the guide rails overlap, the speed of the return rebound of the yarn is restrained so that the leading edge 26 of the arm 7 entering the traverse stroke and which is emerging above the guide rail 9.1, is able to catch up with the yarn and control the guidance of they yarn. Due to the overlapping of the guide rails 9.1 and 9.2, which varies as the traverse stroke proceeds, the yarn is deflected and tensioned in a controlled manner. The guide rails 9.1 and 9.2 overlap such that the changes in yarn tension to be expected are compensated for as completely as possible in the end portion of the traverse stroke H. The exact manner of overlapping depends on the geometrical conditions, and on the yarn speed and traversing speed being utilized. It may be roughly determined by calculation, but is preferably determined from actual experiments.

FIGS. 8–11 illustrate still another embodiment of the invention and wherein the guide rail 9.1 includes a relatively straight edge portion adjacent the end of the traverse stroke which is substantially parallel to the direction of the traverse stroke to define the short initial traverse distance E. The rail 9.1 also includes an inclined portion S adjacent the distance E, and which defines a second traverse distance which acts to frictionally restrain the yarn in its movement toward the center of the stroke.

Figure 8:
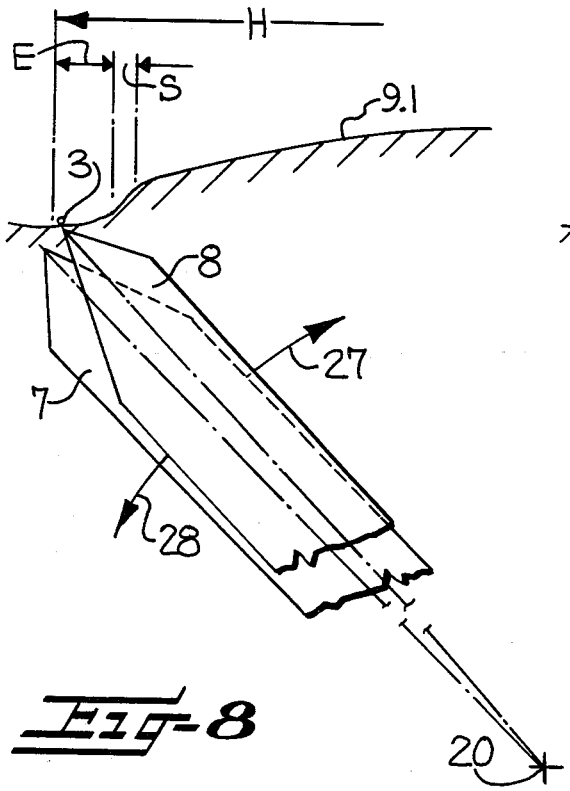
FIGS. 8–11 are views similar to FIG. 3 and illustrating still another embodiment of the invention, with the several views illustrating the different phases of the rotation during the yarn transfer between the rotating arms.

FIG. 8 illustrates the rotor positioning at the moment in which the arm 8 moves below the edge of the guide rail 9.1, thereby discontinuing to guide the yarn. This also defines the end point of the traverse stroke H. As can be seen, at this point in time the arm 7 has not yet moved above the edge of the guide rail 9.1, so that it is unable to take over the guidance of the yarn. For this reason, the yarn rebounds under its own tension in the direction toward the center of the traverse stroke. To control the speed and length of this rebound, the guide rail 9.1 includes at a distance of one to two mm the inclined edge portion S, in which the curvature of the guide rail 9.1 suddenly increases, with curved transitions. In this distance S, the yarn is frictionally braked and restrained. However, it is preferred that the rebounding motion not come to a complete standstill, but should only be restrained.

Figure 9:
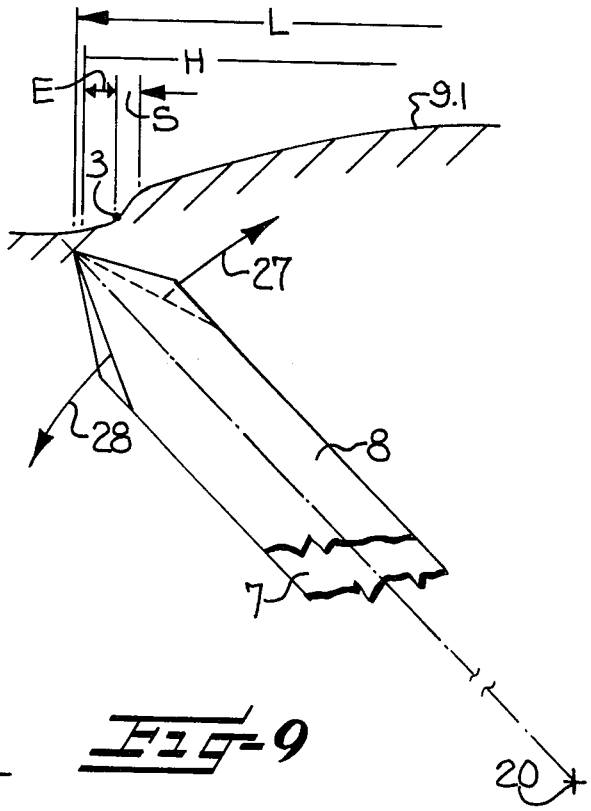

FIG. 9 shows a subsequent moment, wherein the two arms 7 and 8 exactly overlap, i.e., in which the blade tips meet. As will be apparent, at this moment, the yarn is in the process of rebounding and has already left the end of the traverse stroke. However, as it does so, its movement is restrained by the portion S of the guide rail 9.1, since the greater inclination presents an increased resistance to the rebounding movement. It will also be noted from this Figure that the crossing or overlapping point of the outermost tips of the rotating arms is slightly outside the end of the traverse stroke. Thus the secantial distance between the ends of the traverse stroke along the guide rail is less than the secantial distance between the points at which the outermost tips of the guide arms overlap each other adjacent the ends of the traverse stroke.

Figure 10:
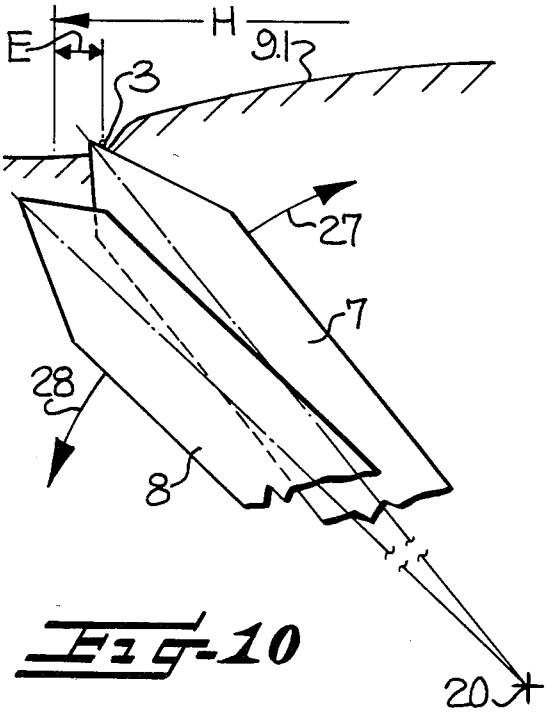

FIG. 10 shows a subsequent moment, in which the approaching blade 7 has caught up with the yarn 3, and commences its guidance of the yarn. At this moment, the tip of the approaching arm 7 projects beyond the edge of the guide rail sufficiently far that a reliable guidance of the yarn is assured. Thus the defined rebound of the yarn insures that the approaching arm is able to emerge from under the guide rail with an adequate length of the leading edge being exposed, so as to be able to properly engage and guide the yarn.

Figure 11:
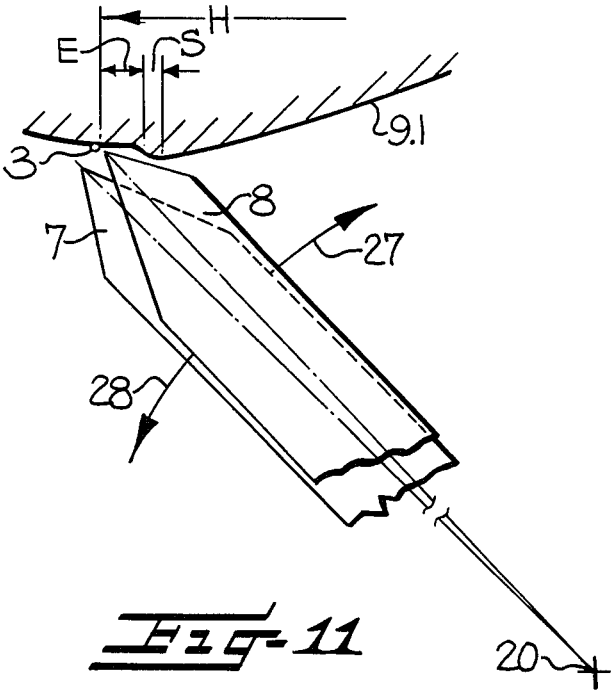

FIG. 11 illustrates an embodiment in which the guide rail 9.1 is located on the side of the yarn path opposite the axes of the rotors of the arms. FIG. 11 corresponds in point of time to that illustrated in FIG. 8, wherein the tip of the leaving arm 8 has discontinued its guidance of the yarn along the guide rail 9.1 In contrast to the embodiment of FIGS. 8–10, it should be noted that the radial distance of the guide rail 9 from the common axis 20 of the arms, suddenly decreases rather than increases in the area S. Otherwise, the configuration of the guide rail according to this embodiment serves the same purpose of restraining the rebound of the yarn in a controlled manner as described above with respect to the embodiment of FIGS. 8–10.

In the drawings and specification there has been set forth preferred embodiments of the invention, and although specific terms are employed, they are used in a generic and descriptive sense only and not for purposes of limitation.

We claim:

1. In a yarn traverse apparatus for reciprocating a running yarn transversely to its running direction over a predetermined traverse stroke, and which includes at each of the ends of the traverse stroke a guide rail extending generally in the direction of the yarn traverse, a pair of guide arms mounted for rotation about closely adjacent parallel, or coaxial, axes and so that the rotating arms define closely adjacent parallel planes and the extremity of each rotating arm is adapted to pass through the yarn path of travel and along the guide rail, and means for rotating the arms in opposite directions so that one arm moves along the guide rail in a direction toward the end of the traverse stroke, and the other arm moves along the guide rail in the opposite direction and from the end of the traverse stroke toward the center of the stroke, with the outer extremity of said one arm including a leading edge facing in the direction of its rotation and which is adapted to contact and move the running yarn toward the end of the traverse stroke where it is released from said leading edge, the improvement therein comprising means for guiding the yarn adjacent each of the ends of the traverse stroke so as to define a distinct short initial traverse distance from the end of the stroke toward the center of the stroke wherein the yarn is released from any positive guidance and is essentially free to move toward the center of the stroke, and a distinct second traverse distance which is adjacent said initial traverse distance wherein the yarn is restrained in such movement by applying a frictional force to the yarn counteracting such movement, whereby proper engagement of the yarn by the extremity of said other arm is assured.

2. In a yarn traverse apparatus as defined in claim 1 wherein said guide rail is disposed on one side of the running yarn, and said means for guiding the yarn adjacent each of the ends of the traverse stroke comprises said guide rail and a further guide rail disposed on the other side of the advancing yarn, and with the two guide rails overlapping each other in plan view along at least said second traverse distance, and with any overlap along said short initial traverse distance being less than the overlap along said second traverse distance.

3. In a yarn traverse apparatus as defined in claim 2 wherein said means for guiding the yarn adjacent each of the ends of the traverse stroke further comprises a trailing edge on the outer extremity of said one arm which extends away from the outermost tip of said leading edge, with said trailing edge including a convexly curved portion for engaging the yarn during its movement through said second traverse distance.

4. In a yarn traverse apparatus as defined in claim 2 wherein said first mentioned guide rail is disposed on the same side of the running yarn as the rotational axes of said guide arms.

5. In a yarn traverse apparatus as defined in claim 2 wherein said further guide rail is arcuately curved along its length.

6. In the yarn traverse apparatus as defined in claim 1 wherein said means for guiding the yarn adjacent each of the ends of the traverse stroke comprises a trailing edge on the outer extremity of said one arm which extends away from the outermost tip of said leading edge, with said trailing edge including a concavely curved portion which extends rearwardly from said outermost tip and a convexly curved portion which extends rearwardly from said concavely curved portion, which portions define said short initial traverse distance and said second traverse distance, and such that the yarn is adapted to move freely toward the center of the stroke before being frictionally engaged by said convexly curved portion.

7. In the yarn traverse apparatus as defined in claim 1 wherein said means for guiding the yarn adjacent each of the ends of the traverse stroke comprises a first edge portion of said guide rail adjacent the end of the traverse stroke and which defines said short initial traverse distance, and a second edge portion of said guide rail adjacent said first edge portion and which defines said second traverse distance, with the second edge portion being inclined with respect to the direction of the traverse stroke so as to frictionally restrain the yarn in its movement toward the center of the stroke.

8. In the yarn traverse apparatus as defined in claim 1 wherein said guide rail extends along the entire length of said traverse stroke, and said pair of guide arms rotate about a common axis, with each guide arm moving along the entire length of the traverse stroke.

9. In the yarn traverse apparatus as defined in claim 8 wherein the secantial distance between the ends of the traverse stroke along said guide rail is less than the secantial distance between the points at which the outermost tips of the guide arms overlap each other adjacent the ends of the traverse stroke.

10. In a method of winding a running yarn onto a rotating bobbin and including reciprocating the running yarn transversely to its running direction over a predetermined traverse stroke, with the reciprocating step including sequentially contacting the running yarn with each of a pair of oppositely rotating guide arms adjacent each end of the traverse stroke such that one arm moves along the traverse stroke in a direction toward the end of the traverse stroke, and the other arm moves along the traverse stroke in the opposite direction and from the end of the traverse stroke toward the center of the stroke, the improvement therein comprising the further step of guiding the yarn adjacent each of the ends of the traverse stroke such that the yarn is essentially free to rebound toward the center of the stroke within a distinct short initial traverse distance from the end of the stroke toward the center of the stroke, and is then restrained in such movement within a distinct second traverse distance which is adjacent said initial traverse distance by applying a frictional force to the yarn counteracting such movement of the yarn toward the center of the stroke, whereby proper engagement of the yarn by the other arm is assured.

11. The method as defined in claim 10 wherein said one arm includes a leading edge facing in the direction of its rotation and the step of guiding the yarn adjacent each of the ends of the traverse stroke includes providing said one arm with a trailing edge which extends rearwardly from the leading edge, and frictionally restraining the yarn from freely moving toward the center of the stroke only after the yarn has moved through said initial traverse distance by contacting the yarn with a portion of the trailing edge during movement of the yarn through said second traverse distance.

12. The method as defined in claim 11 wherein the step of guiding the yarn adjacent each of the ends of the traverse stroke further includes avoiding substantial contact of the yarn with the trailing edge of said one arm during movement of the yarn through said short initial traverse distance.

13. The method as defined in claim 12 wherein the step of guiding the yarn adjacent each of the ends of the traverse stroke further includes contacting the yarn with an edge portion of at least one fixed guide rail during movement of the yarn through said second traverse distance.

14. The method as defined in claim 10 wherein the step of guiding the yarn adjacent each of the ends of the traverse stroke includes contacting the yarn with a pair of fixed yarn guide rails during movement of the yarn through said second traverse distance, with the rails being positioned on respective opposite sides of the yarn.

15. The method as defined in claim 14 wherein the pair of rails overlap each other in plan view so that the yarn is deflected from its running direction by each of the rails during movement of the yarn through said second traverse distance.

16. The method as defined in claim 10 wherein the step of guiding the yarn adjacent each of the ends of the traverse stroke includes contacting the yarn with an edge portion of a fixed guide rail during movement of the yarn through said second traverse distance, with such edge portion being inclined with respect to the direction of the traverse stroke.

* * * * *